US005228871A

United States Patent [19]

Goodman

[11] Patent Number: 5,228,871

[45] Date of Patent: Jul. 20, 1993

[54] SHIELDED CONNECTOR

[75] Inventor: Joseph R. Goodman, Tokyo, Japan

[73] Assignee: AMP Incorporated, Harrisburg, Pa.

[21] Appl. No.: 900,024

[22] Filed: Jun. 17, 1992

[30] Foreign Application Priority Data

Jul. 10, 1991 [JP] Japan ..... 3-194993

[51] Int. Cl.[5] ..... H01R 13/648

[52] U.S. Cl. ..... 439/607; 439/931; 439/108

[58] Field of Search ..... 439/101, 108, 607, 608, 439/609, 610, 931

[56] References Cited

U.S. PATENT DOCUMENTS

| | | | |
|---|---|---|---|
| 4,516,825 | 5/1985 | Brennan et al. | 439/607 |
| 4,659,163 | 4/1987 | Althouse et al. | 439/608 |
| 4,756,695 | 7/1988 | Lane et al. | 439/610 X |
| 4,838,811 | 6/1989 | Nakamura et al. | 439/607 |
| 4,983,127 | 1/1991 | Kawai et al. | 439/609 X |
| 5,052,948 | 10/1991 | Hyzin | 439/609 X |

*Primary Examiner*—Larry I. Schwartz

*Assistant Examiner*—Khiem Nguyen

*Attorney, Agent, or Firm*—Adrian J. LaRue; Timothy J. Aberle

[57] ABSTRACT

An electrical connector (10) of a type adapted to connect signal and ground circuits between a mating connector (60) and a further circuit, board, or cable (50) includes a housing (12) having an interior cavity (20*a*) defined by side, top, and bottom walls (13, 14, 17, and 18) and a rear wall (16) with the surfaces of the housing being conductive to shield signal contacts (24, 26) therein extended through the rear wall (16) via insulating portions (22); the housing including longitudinal slots (30) containing grounding contacts (32) having spring driven edge portions (34) engaging the grounding and shielding surfaces of a mating connector (60) and post portions (38) extending out of the housing to interconnect to the grounding circuit of a further circuit, board, or cable. One embodiment features a plastic housing (12) with a metallic coating defining surface (M) and another embodiment includes a solid metallic housing (40) and a plastic insert (46).

9 Claims, 3 Drawing Sheets

SHIELDED CONNECTOR

FIELD OF THE INVENTION

This invention relates to a shielded and grounded electrical connector construction.

BACKGROUND OF THE INVENTION

Electrical connectors are utilized to interconnect signals and power to and from components such as are used with computers and communication apparatus and the like. Frequently, the signals interconnected are of a level, or have characteristics that can be subject to interference by other signals, voltage transients or the like, or can cross-couple into other signal paths to cause problems. To this end, a practice has evolved of utilizing connectors containing shielding covering over the signal paths, such shielding being grounded to carry off unwanted radiation from interfering with signals carried by the connector; or, to prevent radiation from the connector to other signal paths. With respect to these connectors, considerable attention is paid to the design and practice of intermiting signal contacts to assure a low resistance and stable electrical interface that can be repeatedly mated and unmated in use of the connector. With respect to grounding or grounding shields in the intermating parts of connectors, less attention to design detail frequently results in a grounding or shielding interconnection less than optimum. This is particularly the case with grounding and shielding structures formed of sheet metal or other conductors either unplated or plated with nonprecious metal, such as tin or alloys thereof, the broad areas of shielding structures making the use of precious metal relatively costly as compared with contacts or small portions of contacts. Additionally, in prior art use, grounding and shielding paths are provided by add-on hardware that fits onto, over, or in conjunction with, the connector housings and contacts or cable containing shielding such as braid or surrounding conductive paths.

Accordingly, it is an object of the present invention to provide an improved shield and grounding interconnection for electrical connectors or the like. It is still a further object to provide a grounding shield interconnection incorporated into a connector requiring grounding and shielding. It is still a further object to provide a grounding interconnection that is contained within a connector housing and is useful to interconnect grounding and shielding paths to printed circuit boards, cables, or the like.

SUMMARY OF THE INVENTION

The present invention achieves the foregoing objectives through the provision of an electrical connector having a housing with essentially the entire surface made conductive, and interiorly of such housing, grooves containing grounding contacts that extend interiorly of the housing to effect a grounding and shielding interconnection with a mating connector. In one embodiment, the connector housing is made to have a conductive surface through the provision of a coating formed as by electroplating or electrolessly plating the surface of a plastic housing. In that embodiment, portions of the housing interiorly and exteriorly are either left unplated as by masking or are rendered unplated as by grinding or removal of the coating with signal contacts extended through the insulation from the interior of the housing to the exterior thereof. In another embodiment, the housing itself is made of solid conductive material, machined or cast into a useful configuration. In one embodiment, the signal contacts are formed to interconnect to circuits on a printed circuit board, and in another embodiment, the contacts, signal and grounding, are formed to interconnect to the signal and shielding of a coaxial cable construction. In both embodiments, the shielding and grounding contacts are formed by simple metal stampings that are flat and are made to extend longitudinally of the housing cavity with spring sections into the interior of the housing to engage the conductive portions of a mating connector fitted in such housing. The grounding and shielding contacts, being relatively thin and set on edge, provide an interconnection that bites into the conductive shielding and grounding structure of the mating connector to assure low resistance, stable, electrical interface of grounding and shielding paths. Such contacts extend from the interior of connector housings to the exterior in configurations adapted for termination to printed circuit boards or to the shielding of coaxial cables.

BRIEF DESCRIPTION OF THE DRAWINGS

The invention will now be described by way of example with reference to the accompanying drawings in which.

DETAILED DESCRIPTION OF THE INVENTION

Figure 1:
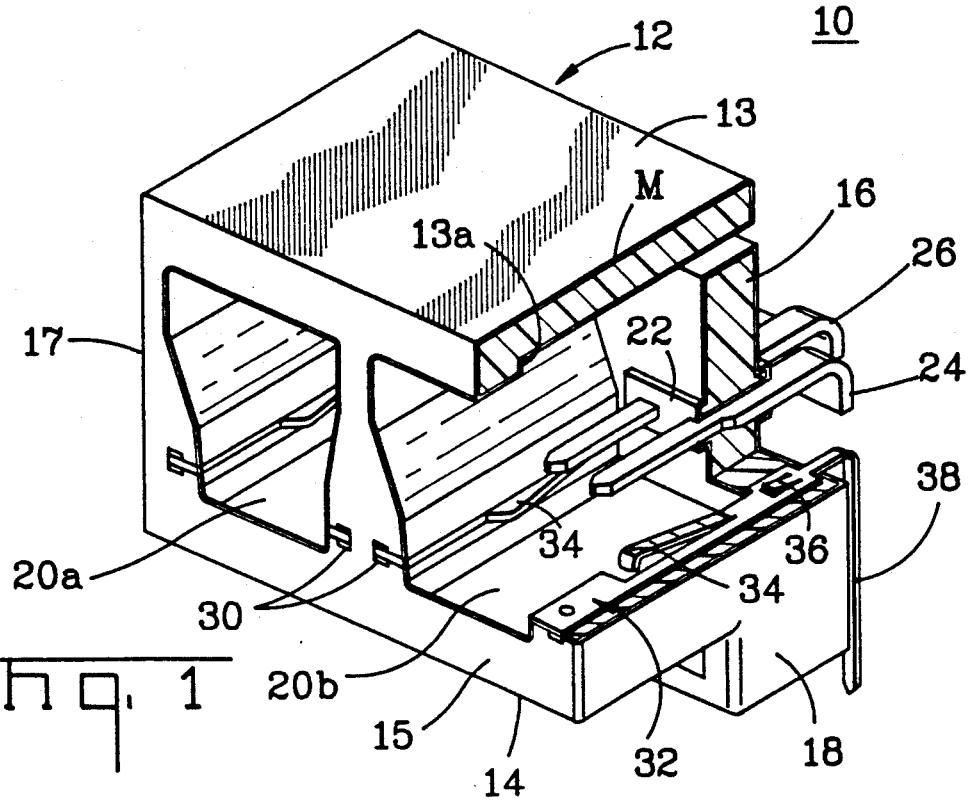
FIG. 1 is a perspective view, partially sectioned, showing an electrical connector in accordance with the invention in one embodiment.

Referring now to FIG. 1, a connector 10 is shown to include a housing 12 having an upper outer surface 13, a bottom surface 14, and side surfaces 17 and 10. The housing 12 includes a rear wall 16 defining with the walls carrying the surfaces 13, 14, 17, and 18 a pair of housing cavities **20*a* and 20*b* that end at the rear wall 16. As shown in FIG. 1 and in FIG. 2, the housing material is made to include projections 22 that extend interiorly of the cavities 20*a* and 20*b* and exteriorly of the rear wall 16. In accordance with the invention concept, the entire surface of housing 16, less the surfaces of projections 22, is coated with a conductive material forming a conductive surface M extending thereover, interiorly and exteriorly, and also extending in slots 30 in the side walls of the housing, within cavities 20*a* and 20*b***.

Figure 2:
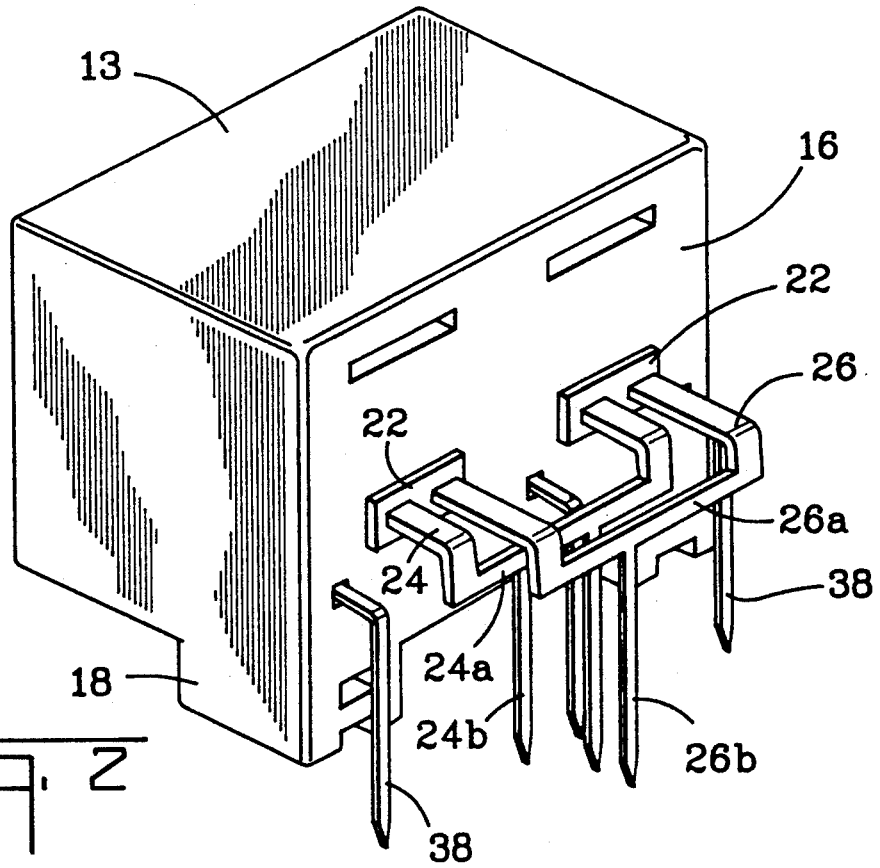
FIG. 2 is a perspective view of the rear of the connector shown in FIG. 1.

Associated with each of the cavities are contacts 24,26 that extend through the insulating portions of the housing 12 in the region of the projections 22 to be isolated and insulated from the conductive surfaces M. As can be seen in FIGS. 1 and 2, the contacts 24 and 26 have contact portions projecting into such cavities to mate with receptacle contacts of a mating connector fitted within the housing 12, a mating connector 60 is shown in in FIG. 3. The contacts 24 and 26 extend out of the housing and have a configuration as shown in FIG. 2, including portions **24*a* and 26*a* that interconnect to post portions 24b and 26b that extend into a printed circuit board, not shown, upon which the connector 10 is mounted and is soldered to conductive traces thereon to interconnect signals carried by the contacts 24 and 26** to components mounted on such board.

Mounted in slots 30 of housing 12 are grounding and shielding contacts 32 that extend from the interior of housing 12 to the exterior to join posts 38 of a configuration shown in FIGS. 1 and 2 that are also inserted into a printed circuit board to be interconnected to the conductive traces or conductive foil representing the grounding and shielding of such board. The contacts 32 include spring portions 34 that extend sideways into the cavities 20a and 20b. Contacts 32 further include latches 36 that engage latch surfaces not shown within the housing rear wall 16 of housing 12. The contacts 32 are stamped and formed in a typical embodiment of spring grade material such that the spring portions 34 provide an edge developing a normal force against the sides of grounding and shielding structures of mating connectors, the sides 62 of the male connectors shown in FIG. 3, which is sufficient to break through the oxides covering the surfaces of the grounding and shielding structures. The side edge nature of the spring portion 34 is intended to provide such force for repeated engagement and to assure a stable, low resistance interface of grounding and shielding circuits. The engagement between the contacts 32 and the conductive surface M extending within slots 30 is made to provide a permanent stable, low resistance interface by suitable means, such as bending of the end of 32 relative to the dimensions of the slots 30, or providing a detent.

Figure 3:
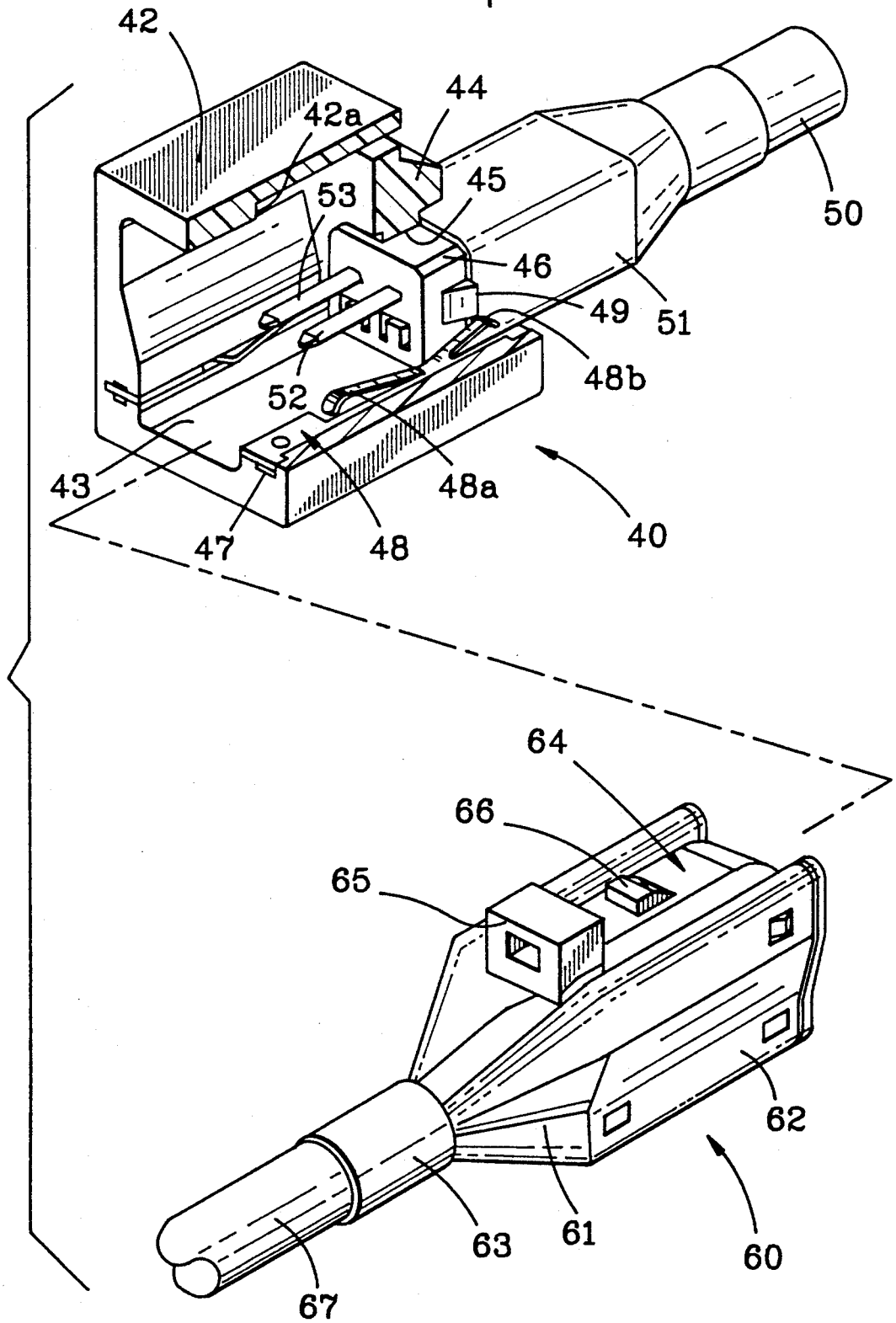
FIG. 3 is a perspective exploded view of the connector in accordance with an alternative embodiment of the invention and a mating connector intended to be inserted therein, the connector of the invention being shown in partial section.

FIG. 3 shows an alternative embodiment useful in connecting a coaxial and shielded cable C. In the embodiment of FIG. 3, the connector 40 includes a housing 42 comprised of a solid metallic shell or body suitably machined or preferably cast into the configuration shown. The housing 42 includes an interior cavity 43 and a rear wall 44 apertured as at 45 to receive a portion of the connector, including an insulating body 46, inserted and latched therewithin by a latch 49 that engages portions of wall 44, not shown.

Figure 4:
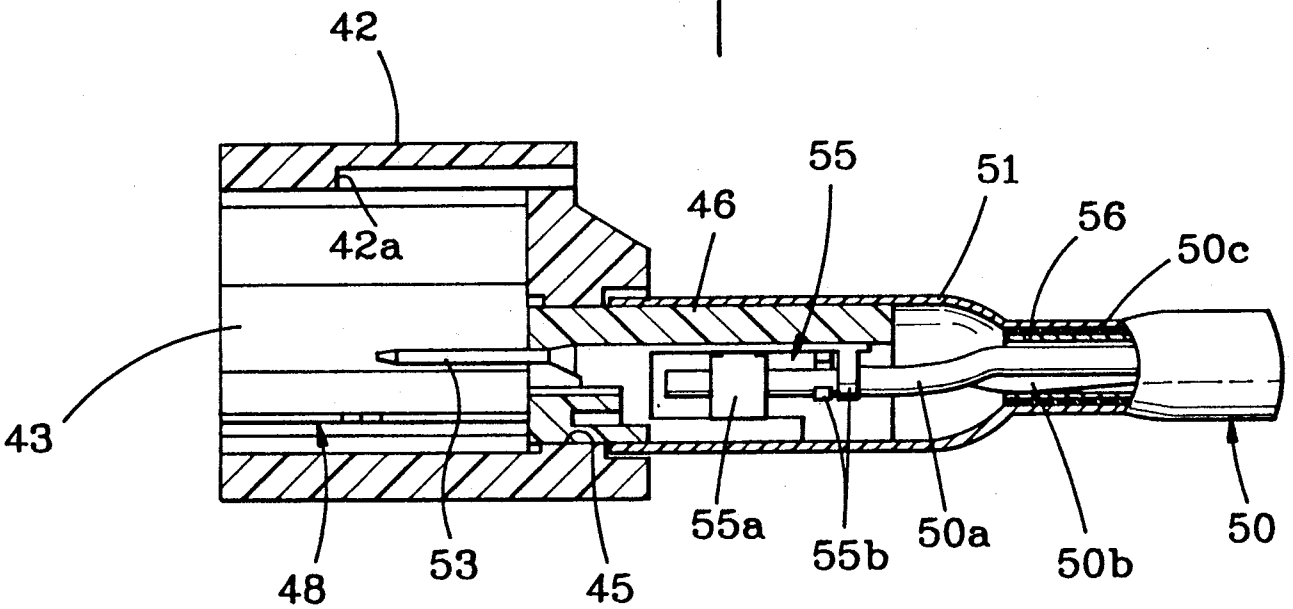
FIG. 4 is a cross-sectional view of the embodiment shown in FIG. 3.

As can be seen in FIG. 3, housing 42 includes slots 47 interiorly of cavity 43 that extend therealong, and these slots have grounding and shielding contacts 48 mounted therein with spring portions 48a extending outwardly of the housing and interiorly into cavity 43. The contacts 48 include further spring portions 48b that extend exteriorly of the cavity 43 to engage a conductive shell 51 of the rear portion of the connector. Connector 40 includes a pair of signal contacts 52 and 53 mounted in the insulating body 46 with ends extending forwardly into cavity 43 to mate with receptacle contacts of the mating connector 60, such contacts not being shown. The contacts 52 and 53 extend rearwardly into cavities within insulating body 46 in the manner shown in FIG. 4. The contacts have insulation displacement elements 55a that penetrate the insulation of signal conductors 50a and 50b made to extend within the connector. U.S. Pat. No. 3,760,331 issued Sep. 18, 1973 shows this type of contact. The contacts 52 and 53 have rear portions 55b that are crimped downwardly to provide strain relief to the cables 50a and 50b mounted in such contacts. An outer conductive and malleable shell 51 is crimped inwardly against the conductive shielding 50c of cable C that surrounds the signal conductors 50a and 50b and onto an inner metal ferrule 56 in the manner shown in FIG. 4. In practice, the cable C would be stripped to an appropriate length with the ends terminated in IDC contacts 55a with the strain relief 55b crimped to provide strain relief to the signal conductors and with the assembly then being fitted within the forward portions of the cavity and through aperture 45 and latched therein.

The mating connector 60, terminated also to a cable C as by a ferrule 63, interconnecting the ground shield path to an outer shielding structure 61 having side walls 62 that engage the spring portions 48a of contacts 48 in the mating connector. The connector 60 includes a stop portion 65 that limits insertion of the connector 60 within the cavity 43 and a latch portion 64 carrying a latch projection 66 that engages an interior surface 42a, as shown in FIG. 3, to latch the connector halves together. The housing 12 of the embodiment of FIG. 12 includes an interior surface 13a similar to surface 42a for the same purpose and use. As the connector half 60 is inserted in cavity 43, the edge surfaces of spring portions 48a will engage the conductive surface of side walls 62 and effect an electrical interconnection of grounding and shielding paths from cable C as terminated to connector half 60 to cable C as terminated by connector 40.

In this way, a simple and inexpensive solution to the problems of interconnecting to the grounding and shielding surfaces of connector housings is provided. The grounding and shielding contacts are permanently attached and require no external hardware or manipulation to assure a sound interconnection of paths, and the invention features a use in a variety of embodiments, two of which are shown representing an interconnection to a circuit, such as a printed circuit board or the like, and an interconnection to a cable. Other uses of the invention are contemplated, and other configurations of connectors as well.

Having now described the invention in terms intended to enable a preferred practice thereof in its several modes, claims are appended and intended to define what is inventive.

I claim:

1. An electrical connector for connecting signal and ground circuits between a matable connector and a circuit board or cable, comprising:

a housing having side, top, bottom and rear walls defining a connector-receiving cavity, the surfaces of the side, top, bottom and rear walls of the housing being electrically conductive, and said rear wall of said housing including an exposed dielectric section;

signal contacts secured in said dielectric section of said rear wall and having contact sections disposed within said connector-receiving cavity and termination sections extending exteriorly of said rear wall for electrical connection to signal conductors on the circuit board or to signal conductors of the cable; and a ground contact secured in a slot extending along an interior surface of said connector-receiving cavity, said ground contact having a spring contact portion extending into the connector-receiving cavity for electrical connection with a shield member of the meltable connector when said matable connector is inserted into the connector-receiving cavity, said ground contact also having a termination portion for electrical connection with a ground conductor on the circuit board or with a conducive shield of the cable.

2. An electrical connector as claimed in claim 1, wherein said side, top, bottom and rear walls of said housing are made of dielectric material having an electrically conductive coating thereon constituting said electrically conductive surfaces.

3. An electrical connector as claimed in claim 2, wherein said dielectric section of said rear wall is part of said dielectric material of said rear wall without said electrically conductive coating on inner and outer surfaces thereof.

4. An electrical connector as claimed in claim 1 wherein said termination sections of said signal contacts comprise post sections.

5. An electrical connector as claimed in claim 1, wherein said termination portion of said ground contact comprises a post portion.

6. An electrical connector as claimed in claim 1, wherein said side, top, bottom and rear walls of said housing are made f metal.

7. An electrical connector as claimed in claim 6, wherein said dielectric section of said rear wall comprises a dielectric insert secured in an opening of said rear wall.

8. An electrical connector as claimed in claim 1, wherein said termination sections of said signal contacts have termination members for electrical connection to signal wires of the cable.

9. An electrical connector as claimed in claim 1, wherein said termination portion of said ground contact comprises another spring contact portion for electrical connection to a shield member of the cable.

* * * * *